US007017587B2

(12) United States Patent
Kurokawa

(10) Patent No.: US 7,017,587 B2
(45) Date of Patent: Mar. 28, 2006

(54) DEVICE FOR REMOVING ENAMEL FROM THE NAILS

(76) Inventor: Sumie Kurokawa, 17-13, Mure Imajuku 1-chome, Hofu-shi, Yamaguchi-ken (JP)

( * ) Notice: Subject to any disclaimer, the term of this patent is extended or adjusted under 35 U.S.C. 154(b) by 175 days.

(21) Appl. No.: 10/185,733

(22) Filed: Jul. 1, 2002

(65) Prior Publication Data

US 2003/0226570 A1 Dec. 11, 2003

(30) Foreign Application Priority Data

Jun. 6, 2002 (JP) ..... 2002-165189

(51) Int. Cl.
*A45D 29/18* (2006.01)
*A46B 11/00* (2006.01)

(52) U.S. Cl. ..... 132/73.5; 401/126

(58) Field of Classification Search ..... 132/73, 132/73.5, 75, 74.5; 401/118, 126
See application file for complete search history.

(56) References Cited

U.S. PATENT DOCUMENTS 4,321,936 A * 3/1982 Chaconas ..... 132/75
5,613,506 A * 3/1997 Kurokawa ..... 132/73
5,855,212 A * 1/1999 Walker ..... 132/73.5
6,290,418 B1 * 9/2001 Frey ..... 401/126

* cited by examiner

*Primary Examiner*—Kevin Shaver
*Assistant Examiner*—Stephanie L. Willatt
(74) *Attorney, Agent, or Firm*—Manabu Kanesaka

(57) ABSTRACT

Unless the nail exposure window of the finger protection sheath is strictly adjusted, the enamel-coated nail portion only is not brought into contact with the spongy member, and the enamel is not reliably and selectively wiped off without hurting the skin. Further, the finger protection sheath does not easily turn unless a large moment of turn is given thereto. The lower rotary shaft of the finger protector sheath of nearly a hollow cylindrical shape is deflected from the finger axis or the center line of the cone in a manner that they meet at θ, enabling the outer diameter portion of the enamel-coated nail surface to be turned like a fan maintaining a radius R(=r+Δr) larger than the radius r of the prior art as viewed on a plan view to increase the moment of turn. The nail exposure portion is provided with an automatic cover to thereby also contrive an installation-type device for removing enamel from a multiplicity of nails and a device for removing enamel from the pedicured nails.

20 Claims, 5 Drawing Sheets

DEVICE FOR REMOVING ENAMEL FROM THE NAILS

BACKGROUND OF THE INVENTION

1. Field of the Invention

The present invention relates to a device for removing enamel from the nails. More specifically, the invention relates to a device for removing enamel from the fingernails or toenails, by permitting only those nail portions on where the enamel is applied to be brought into contact with, and rubbed onto, the spongy member impregnated with a removing solution along a fan-like curved surface.

2. Description of the Related Art

A manicure (nail enamel) is one of the makeup methods performed for the fingernails. A manicure that is applied to the toenails is called pedicure. Both of them are beauty treatments for applying a clear or colored enamel onto the nails. The manicure chiefly comprises a film-forming agent such as nitrocellulose, resins that impart luster and adhesive property to the film, a solvent such as plasticizer, alcohol, ester or ketones, and a coloring material which may be a dye or a pigment. Hereinafter, the manicure includes the pedicure unless stated otherwise.

In recent years, it has been discovered that the nitrocellulose which is a film-forming agent reacts with keratin which is a protein that constitutes the nail causing the nail to become yellow. Therefore, there has been developed the one which uses an emulsified polymer and water using neither the nitrocellulose nor the organic solvent, which, however, has not yet been widely used.

A solvent and an alkali solution have heretofore been used as a removing solution (delustering solution) for removing the manicure film. That is, a spongy material which may be simply a dewaxed cotton or a sponge (inclusive of soft plastic foamed material) is impregnated with the removing solution and is used to simply wipe the nails. Therefore, it often happens that the removing solution adheres to the fingers and toes in addition to the manicure films, the manicure dissolved in the removing solution adheres to the vicinities making it difficult to completely remove the manicure and, besides, a large amount of the removing solution adheres to the nails and to the fingertips causing the nails and the fingertips to be hurt. Due to such a dangerous nature and bother of use, quite a few of women hesitate to use the manicure.

Besides, the conventional manicure-removing solution evaporates into the atmosphere through a small gap and vanishes. When the cap is not tightly closed or when left to stand for extended periods of time, the manicure-removing solution often fails to work, which is a problem.

The present inventor, therefore, has previously contrived a simply constructed device for effectively removing the manicure solving the above-mentioned problem and on which patent was granted already (Japanese Patent No. 2741487, entitled Device for Removing Manicure).

The inventor, however, has still found inadequacy in the above invention and has attempted to further improve the invention.

The inventor has discovered that upon pivoting a finger protection sheath at an end thereof on the bottom of a container, the positioning can be accomplished maintaining improved precision and upon forming a cavity in an elastic flange portion to store the removing solution and supplying the removing solution into the container through a small hole utilizing the finger pressure, the device can be put into use even when the spongy member in the cylinder is dried.

The inventor has thus accomplished the device for removing enamel featuring a long life (Japanese Patent Application No. 103339/2000). With the structure in which the lower central portion of the finger protection sheath of a hollow conical shape having bottom is pivoted to the central portion of the bottom of the container, however, the exposed nail portion is not still selectively brought into contact with the spongy member to a sufficient degree.

Without any cover for the exposed nail portion, further, it is likely that even undesired surfaces of the fingers other than the nails are wiped.

SUMMARY OF THE INVENTION

It is therefore an object of the present invention to provide a device for removing enamel in which, when a closure is closed, the removing solution or the volatile gas such as a solvent is prevented from being exposed, the closure is opened only when needed enabling an enamel-applied fingertip to be inserted and turned therein so that the enamel-applied nail only is brought into contact with the spongy member, enabling the enamel film to be easily removed, without permitting skin portions of fingers or toes to be get hurt, but permitting the nail to be brought into contact with the spongy member for an extended period of time safely and reliably.

Another object of the present invention is to supply the removing solution stored in a flexible cavity in the flange to the spongy member in the container to replenish the loss of the removing solution which continues to evaporate through a small gap irrespective of when the device is in use or not in use.

A further object of the present invention is to positively and selectively wipe only the nails irrespective of the presence of covers by arranging the finger protection sheaths of different hollow conical shapes in a deviated manner.

The present invention provides:

A device for removing enamel from a nail of a toe or finger comprising:

a nearly cylindrical container having an open end and an opposing bottom, the bottom for accommodating, along an inner wall surface thereof, a spongy member impregnated with a removing solution;

one or more finger protection sheaths each having a substantially cylindrical or conical shape and having a lower end opposed by an upper opening end, each finger protection sheath further having a nail exposure window opening upward from near the lower end, each finger protection sheath being suspended at a flange portion extending from the upper opening end so as to rotate about a first axis that extends between the upper opening end and the bottom of the cylindrical container; and a container closure having an inverse U-shape in cross section and fixed at the open end of the container;

wherein the lower end of each finger protection sheath extends about a second axis that is deflected from the first axis by an angle θ, where $1° \leqq \theta \leqq 30°$;

A device for removing enamel from a nail of a toe or finger as set forth above, wherein each finger protection sheath comprises an elastic material and/or a rubber and/or a metal and/or a ceramic material having an inner cavity portion with a cross section of a predetermined average human finger or toe size;

A device for removing enamel from a nail of a toe or finger as set forth above, wherein each finger protection sheath includes a pair of overlapping semicircular closure valves comprising a soft plastic film affixed adjacent the upper opening end;

A device for removing enamel from the nails as set forth above, wherein the removing solution comprises a solvent and/or a detergent and water;

A device for removing enamel from the nails as set forth above, wherein an annular or a partly annular cavity is formed in the flange portion of the finger protection sheaths made of the elastic material and/or the rubber;

A device for removing enamel from the nails as set forth above, wherein the removing solution is contained in advance in the annular or partly annular cavity, and is fed to the spongy member in the container through small holes formed at a lower part of the cavity due to the expanding compressive motion produced by the fingers;

A device for removing enamel from the nails as set forth above, wherein the small holes are of the automatically closing type which are perforated by using an injector needle; and A device for removing enamel from the nails as set forth above, wherein the spongy member is a thick tubular sponge (soft plastic foamed material) which is inverted and having numerous continuing bubbles.

DETAILED DESCRIPTION OF THE INVENTION

Figure 1A:
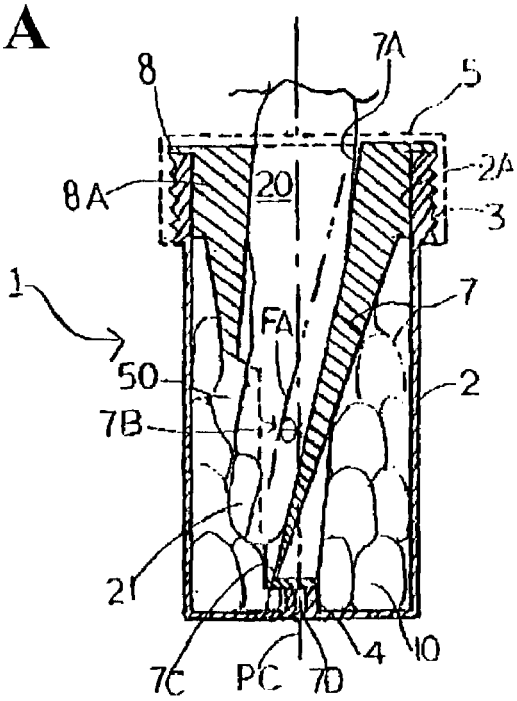
FIG. 1A is a sectional view of an embodiment as viewed from the side.
Figure 1B:
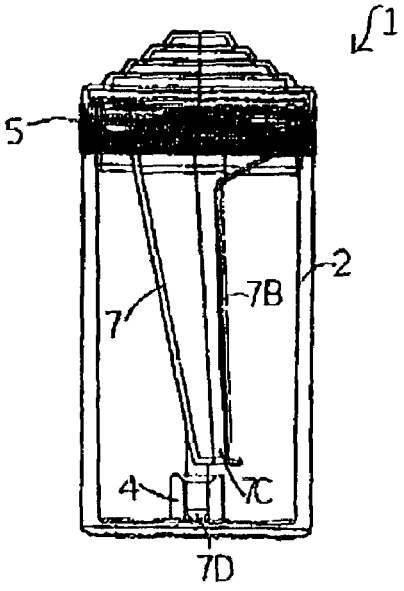
FIG. 1B is a side view of another embodiment.
Figure 1C:
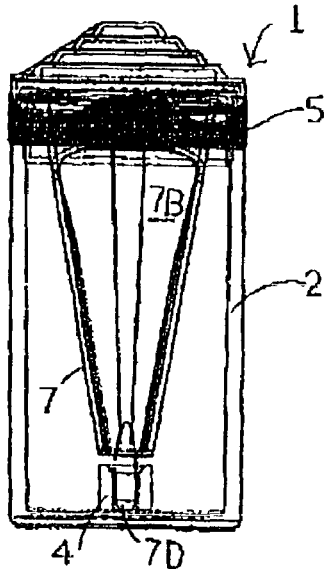
FIG. 1C is a front view of the embodiment.

The invention will now be described by way of an embodiment.

In FIGS. 1A to 16, reference numeral 1 denotes a device for removing enamel from the nail, 2 denotes a cylindrical container having bottom, 2A denotes an opening of the container, 3 denotes a threaded portion, 4 denotes a bearing, 5 denotes a closure of the container, 7 denotes a finger protection sheath, 7A denotes a finger insertion hole, 7B denotes a finger exposure window, 7C denotes an end of the finger protection sheath, 7D denotes a support shaft, 7E and 7F denote window frame flanges, 7R denotes a rail, 7S denotes a cover, 7T denotes a telescopic portion, 8 denotes an expanded flange portion (packing portion), 8A denotes a flange portion, 9 denotes a cavity (removing solution tank), reference numerals 10, 10A, 10B and 10C denote spongy members, 20 denotes a finger, 21 denotes a nail, 24 denotes a toe, 30 denotes a removing solution, 31 denotes a core member, 42 denotes a small hole, 43 denotes an injection of the removing solution, 50 denotes a gap, 54 denotes small holes, 55 denotes a middle bottom, 60 denotes an installation-type device for removing enamel from a multiplicity of nails, 60A denotes a container thereof, 70 denotes a semicircular closure valve, 70A denotes an overlapped portion, 71 denotes a rubber ring for engagement, 80 denotes a device for removing enamel from the pedicured nail, and 80A denotes a container thereof. Symbol PC denotes a rotational axis of the finger protection sheath, and FA denotes an axis of a portion of a finger about which a lower portion of the finger protection sheath extends.

In FIGS. 1A to 4, the bearing 4 is constituted integrally with the container nearly at the center on the bottom of the cylindrical container 2, and the interior of the container is packed, along the inner wall thereof, with the spongy member 10 impregnated with the removing solution. In FIG. 1A, the finger protection sheath 7 is of a hollow conical shape having a high rigidity and a thickness which is tapered to decrease toward the lower side. In the case of FIG. 2A, the finger protection sheath 7 is as soft as a rubber glove, and is intimately fitted to the surface of the finger 20.

In any one of FIGS. 1A, 1B, 1C, 2A and 2B, the center of the flange portion 8A at the upper end of the container is aligned with the support shaft 7D at the lower end thereof, and thereby defines axis PC about which the finger protection sheath 7 rotates. Axis PC is deflected by an angle $\theta$ at an intersecting point from an axis associated with at least a portion of the rotatable hollow conical finger protection sheath 7, i.e., from the axis FA connecting the first joint to the second joint of a finger (or, if simply described, the axis of the finger in the lengthwise direction). In other words, the finger insertion hole 7A and corresponding hollow portion of the finger protection sheath 7 extend about an axis that is deflected relative to axis PC. The angle $\theta$ is preferably at least about 1° to obtain the effect of increasing the radius of circumference, as is explained below. If the angle $\theta$ exceeds about 30°, then the outer diameter of the finger protection sheath may become too large, which is not practicable. Therefore, the angle $\theta$ is selected to be about $1° \leqq \theta \leqq 30°$ in exemplary embodiments.

Figure 7:
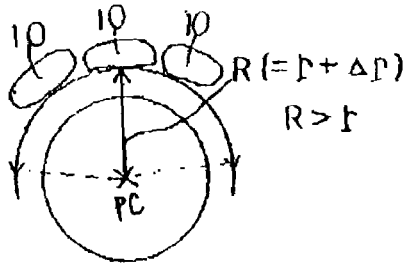
FIG. 7 is a plan view illustrating a state where a locus of outer diameters of the nail surfaces is expanding according to the embodiment.
Figure 8:
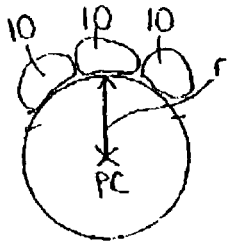
FIG. 8 is a plan view illustrating a conventional locus of outer diameters of the nail surfaces.

Therefore, according to the present invention as shown in FIG. 7 the nail tip comes into contact with the spongy member maintaining a radius R ($=r+\Delta r$) which is larger by $\Delta r$ than the radius of circumference of a conventional simple conical outer periphery shown in FIG. 8. Even without the cover, therefore, the fingertip is selectively wiped. In addition, since the end of the axis FA of a finger inserted in the protection sheath is deflected outward beyond the rotational axis PC of the protection sheath, the moment of rotation for turning the protection sheath about axis PC is easily obtained, and the finger can be lightly turned compared to that of using the prior art.

It needs not be pointed out that the operation becomes more reliable if the finger, except for the nail tip, is covered with a cover that will be described later.

Figure 3:
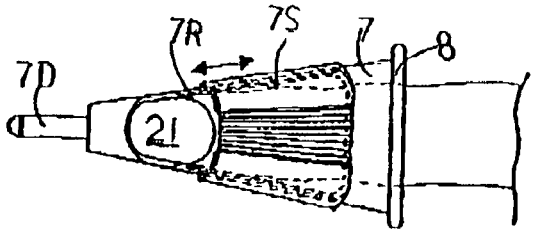
FIG. 3 is a plan view of a finger protection sheath with a cover.
Figure 4:
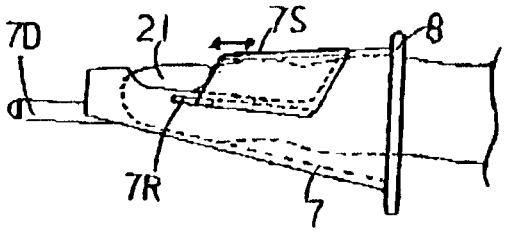
FIG. 4 is a side view thereof.
Figure 5:
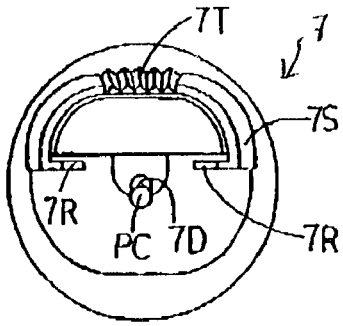
FIG. 5 is a bottom view of the finger protection sheath with a cover as viewed from the direction of a pivot axis.

Referring to FIGS. 3 and 4, if a cover having a telescopic portion 7S is allowed to slide up and down over a distance of about 2 to 6 mm along a pair of rails 7R and 7R provided along the window frame in the axial direction of the finger exposure window, the nail can be selectively wiped more easily. If the cover is moved up and down by the fingertip relying upon the friction, then, the cover can be automatically opened and closed.

Figure 6:
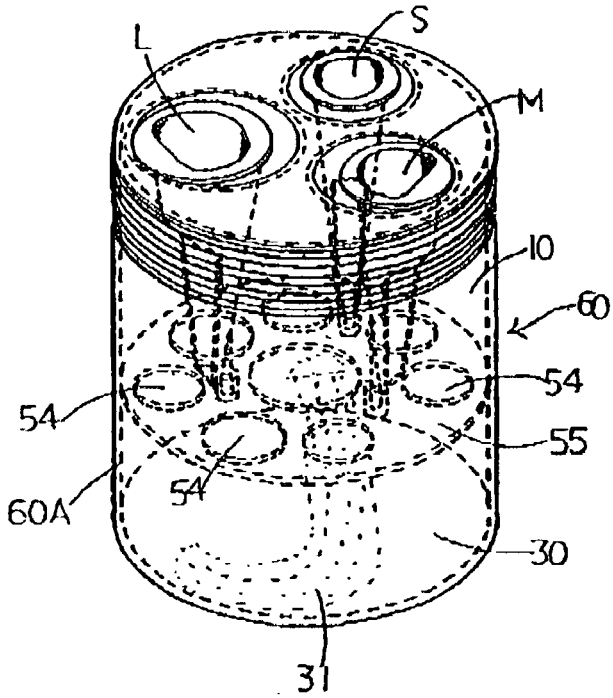
FIG. 6 is a perspective view of the installation-type device for removing enamel from a multiplicity of nails of an embodiment in which three finger protection sheaths of S-, M- and L-sizes are set into an installation-type cylindrical container having a bottom.

Next, if a plurality of large and small rotary finger protection sheaths are arranged on the closure of the device 60 for removing enamel from a multiplicity of nails, which is installed on a desk or on a floor as shown in FIG. 6, then, the device can be used by family members having fingers of different sizes. In this case, a middle bottom 55 having a plurality of holes 54 is secured to the inner wall of the container 60A, and the bearings 4 of the finger protection sheaths 7 are secured to the upper surface thereof, so that the protection sheaths 7 are freely turned by the fingers inserted from the upper side. Further, the removing solution 30 is stored in the bottom portion, and is communicated with the upper spongy member through the core member 31 so as to be supplied by a required amount to the spongy member relying upon the capillary tube phenomenon.

Referring to FIGS. 1A to 4, a nail exposure window 7B is opening expanding upward from the end 7C of the protection sheath 7. Referring to FIG. 2, the nail exposure window includes a nail exposure window 7B having a relatively small opening surrounding the nail 21 and, further, includes the nail exposure window 7B having a relatively large opening which is opening up to an upper portion as shown in FIGS. 1A to 1C.

Figure 2A:
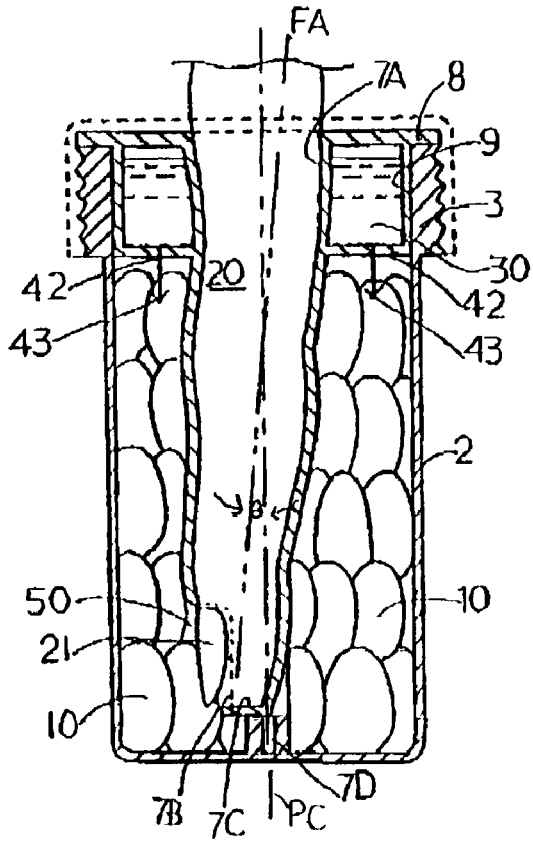
FIG. 2A is a sectional view of another embodiment.
Figure 2B:
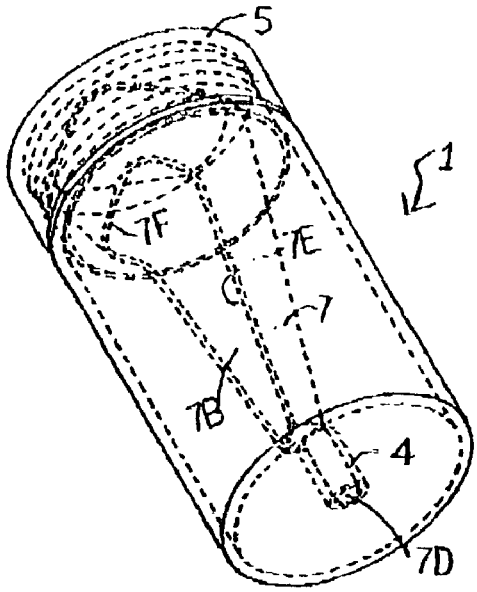
FIG. 2B is a perspective view of the embodiment as viewed from a lower inclined direction.

In the case of FIG. 2A, only the nail 21 is exposed, and the effect of the invention is obtained without causing hurt to the skin portions. At the time of removing the finger, however, the user may often find it difficult to remove the finger since it is intimately fitted to the finger protection sheath. Depending on the cases, the sheath 7 is deformed due to wrapping that often happens when a person attempts to remove the fingers from a rubber glove, whereby the support shaft 7D separates away from the bearing 4 and it becomes difficult to remove the finger. By using the finger protection sheath having a rigidity which is high to some degree as shown in FIG. 1, on the other hand, even when the nail exposure window is formed wide to some extent, the wall of the opposite side expands the spongy member 10 upon turning the finger inserted in the finger insertion hole 7A by 90 to 180°. Therefore, a gap 50 develops, and exposed portions except the nail 21 do not produce friction. In this case, the finger can be very favorably removed since the finger is not entangled by the sheath.

When the sizes of the fingers change greatly, the device of the type of FIG. 1 can meet a wider range of application than the device of the type of FIG. 2. The support shaft 7D is formed at the end of the sheath 7 integrally therewith being deflected toward the side opposite to the nail exposure window, and is pivoted to the bearing 4 on the bottom surface of the container. Irrespective of the rigidity of the sheath 7, therefore, the position of the sheath 7 itself is maintained if the finger to be removed is not entangled by the sheath 7.

An annular flange portion 8A is formed at an upper part of the sheath 7, an extending flange portion 8 is formed at an upper portion thereof extending in an annular manner, and the role of packing is played by the upper end surface of the upper opening portion 2A of the container 2 and by the container closure 5. The upper outer side surface of the container 2 is threaded as designated at 3, and engages with the threaded part on the inside of the outer container closure.

The container 2 may be made of a transparent/translucent/opaque glass or hard plastic, and the container closure 5 is made of a semi-cured or cured plastic. In contrast thereto, the finger protection sheath 7 is integrally formed of a soft or semi-hard/hard elastic material (elastomer) or a rubber, or is formed of a mechanical combination thereof.

For example, the extended flange portion that must have a packing action is made of a synthetic rubber, and other flange portion 8A and the barrel of the sheath may be made of a solvent-resistant plastic material. In any way, the plastic or the rubber featuring good workability and resistance against alkali or against solvent, are preferably used. The material of the finger protection sheath may be various rubbers, elastomers as well as various plastics, hard aluminum, aluminum alloys, a stainless steel or various ceramics, or combinations thereof.

Referring to FIGS. 3, 4, 5 and 8, the finger insertion hole 7A has a nearly semicircular shape for good adaptability to the finger and for transmitting the torque produced by the turn of the finger to the sheath 7 as a whole. It needs not be pointed out that the sheath is not limited to the one of the hollow cylindrical shape but may be of a cylindrical shape with a bottom.

Upon providing the edge of the nail exposure window 7B of the sheath with window frame flanges 7E and 7F which are protruding inward, the window 7B itself exhibits an increased rigidity and, besides, and finger 20 and the sheath 7 can be reliably secured over the periphery of the finger exposure window 7B.

The window frame flanges 7E and 7F (7E is along the axial direction and 7F is along the direction nearly at right angles with the axis) are not necessarily needed when the nail exposure window 7B is designed in a favorable size. What is important, in one embodiment, is that the sheath 7 has an inner cavity with a cross section of a predetermined average human finger or toe size so as to accomodate a wide range of finger or toe sizes.

When the container closure is forgot to be closed or is not completely closed, the removing solution containing the solvent vaporizes and is lost, bringing about such an inconvenience that the device does not work when it is desired. As shown in FIG. 2A, therefore, the flange portion 8A of the sheath 7 is provided with an annular cavity (removing solution tank) 9 or a partly annular cavity having a separator wall, and the removing solution is stored therein in advance by being injected from the lower side by using an injector. Then, the removing solution 30 can be easily replenished to the dry spongy member 10 in the container.

Figure 9:
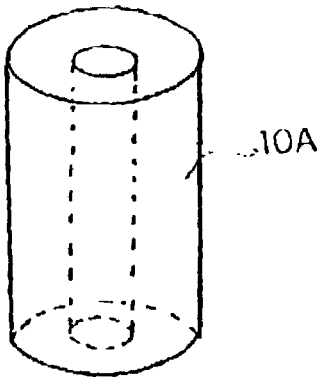
FIG. 9 is a perspective view of a spongy member (thick tubular sponge) constituting a portion of the embodiment.
Figure 10:
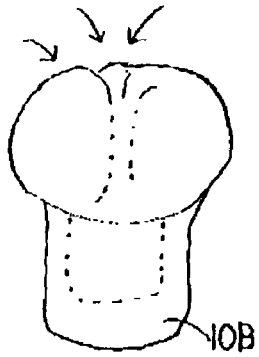
FIG. 10 is a perspective view of the spongy member of FIG. 9 being inverted.
Figure 11:
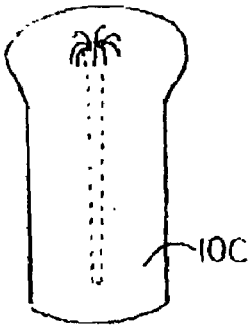
FIG. 11 is a perspective view of the spongy member of FIG. 10 in the form of a mushroom after inverted.

To do this, the sheath 7 is taken out, and the removing solution 30 is injected therein through the bottom of the flange 8A by using an injector. In order to contain the removing solution in the cavity 9 as much as possible by preventing the air from staying, it is recommended that the flange portion 8A is pushed and contracted, and the removing solution 30 is injected by pushing the injector by another hand. Then, the sheath 7 is set into the container 2, the finger is moved in the direction of arrow as shown in FIG. 2, and the periphery of the finger insertion hole 7A is compressed and expanded. Due to the resiliency of the material, therefore, the small hole 42 which had been contracted and closed after the injector needle is pulled out is slightly opened, and the removing solution is injected downward as designated at 43, 43, and the spongy member 10 is wet again to a sufficient degree due to gravity and capillary tube phenomenon. When a thick tubular sponge 10A shown in FIG. 9 is inverted back side front by forcibly inserting it into itself by a finger as indicated by arrows in FIG. 10, there is obtained a mushroom-like sponge 10C as shown in FIG. 11. By using this sponge member in the container, the inner surfaces comes into contact with the finger protection sheath at a relatively increased density, and there are obtained a suitable degree of pressure for the nail surface and the removing solution in a limited space in the container.

Figure 15:
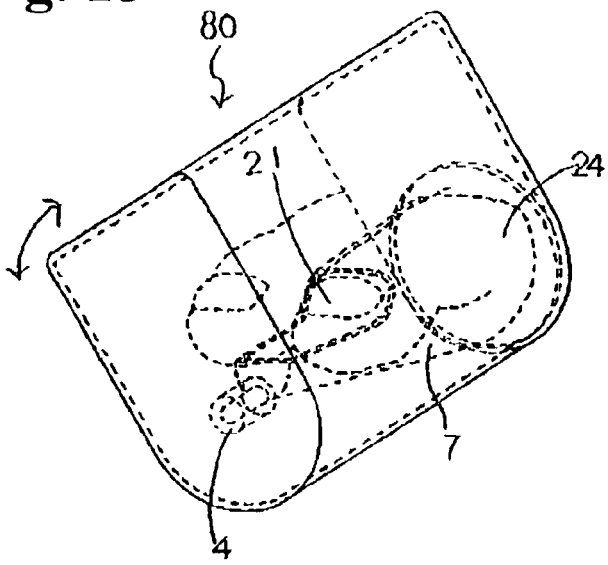
FIG. 15 is a perspective view of a device for removing enamel from the pedicured nail.
Figure 16:
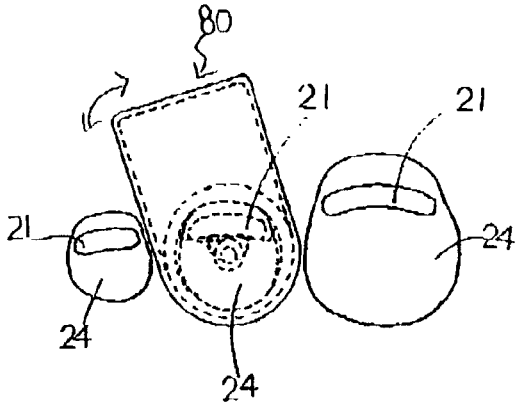
FIG. 16 is a front view thereof.

FIGS. 15 and 16 illustrate a device for removing enamel from the pedicured toes, which is designed by taking into consideration the facts that the toe cannot be inserted downward and that the toes cannot be easily opened from each other. That is, the container 80A is a thin rectangular parallelepiped having a thickness which is slightly greater than the diameter of the toe. The toe is inserted in nearly the horizontal direction, and the container itself is turned toward the right and left. The space in the container without the finger protection sheath is capable of storing a relatively large amount of the spongy member impregnated with the removing solution.

Figure 12:
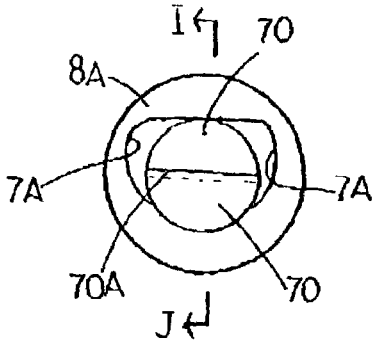
FIG. 12 is a plan view of the finger protection sheath provided with semicircular closure valves.
Figure 13:
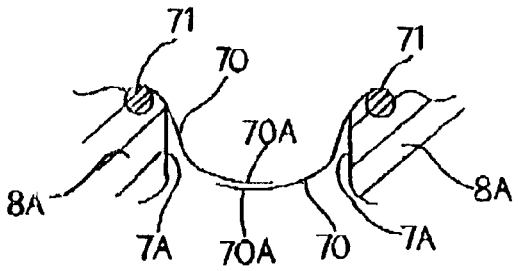
FIG. 13 is a sectional view along the line I–J in FIG. 12.
Figure 14:
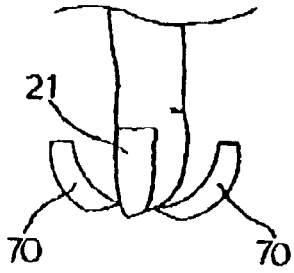
FIG. 14 is a schematic view in a state where the semicircular closure valve is opened.

FIGS. 12, 13 and 14 are a plan view of the finger protection sheath provided with a semicircular closure valve, a sectional view along the line I–J in FIG. 12, and a schematic view illustrating a state where the semicircular closure valve is opened. Usually, a pair of closure valves 70 and 70 are overlapped on an overlapping portion 70A and are closing the hole. When a finger is inserted, the closure valves are opened by the fingertip or by the nail tip as shown in FIG. 15 to a required degree of opening. When the finger is removed from the finger protection sheath, the semicircular closure valves close the hole due to their own resilient restoring force. In order to firmly secure the semicircular closure valves to the flange portion 8A of the finger protection sheath, the flange portions of the closure valves are fastened by a rubber ring for engagement like that of a fingerstall, so that the closure valves will not be easily broken by the finger that is inserted and removed.

The above-mentioned objects are all accomplished by putting the invention into practice. When the closure is closed, the removing solution or the volatile gas such as of the solvent is prevented from leaking. That is, there is provided a long-lasting device for removing enamel permitting the closure to be opened only when necessary and enabling the enamel-coated fingertip to be easily inserted and turned to thereby easily and selectively remove the enamel film without causing the skin portions of the finger to be get hurt by the removing solution.

Further, the removing solution stored in the flexible cavity in the flange is supplied to the spongy member in the container to compensate a loss of the removing solution which is subject to be vaporized through a small gap irrespective of whether the device is in use or not in use.

What is claimed is:

1. A device for removing enamel from a nail of a toe or finger comprising:

a nearly cylindrical container having an open end and an opposing bottom, the bottom for accommodating, along an inner wall surface thereof, a spongy member impregnated with a removing solution;

one or more finger protection sheaths each having a substantially cylindrical or conical shape and having a lower end opposed by an upper opening end, each finger protection sheath further having a nail exposure window opening upward from near the lower end, each finger protection sheath being suspended at a flange portion extending from the upper opening end so as to rotate about a first axis that extends between the upper opening end and the bottom of the cylindrical container; and a container closure having an inverse U-shape in cross section and fixed at the open end of the container;

wherein the lower end of each finger protection sheath extends about a second axis that is deflected from the first axis by an angle θ, where $1° \leqq \theta \leqq 30°$.

2. A device for removing enamel from a nail of a toe or finger as set forth in claim 1, wherein each finger protection sheath is made of at least one of an elastic material, rubber, metal and a ceramic material having an inner cavity portion with a cross section of a predetermined average human finger or toe size.

3. A device for removing enamel from a nail of a toe or finger as set forth in claim 1, wherein each finger protection sheath includes a pair of overlapping semicircular closure valves comprising a soft plastic film affixed adjacent the upper opening end.

4. A device for removing enamel from a nail of a toe or finger as set forth in claim 1, wherein the removing solution comprises a solvent, a detergent and water or a mixture thereof.

5. A device for removing enamel from a nail of a toe or finger as set forth in claim 1, wherein an annular or a partly annular cavity is formed in the flange portion of the finger protection sheaths made of at least one of an elastic material and rubber.

6. A device for removing enamel from a nail of a toe or finger as set forth in claim 1, wherein the removing solution is contained in advance in the annular or partly annular cavity, and is fed to the spongy member in the container through small holes formed at a lower part of the cavity due to expanding compressive motion produced by the fingers.

7. A device for removing enamel from a nail of a toe or finger as set forth in claim 6, wherein the small holes are perforated by using an injector needle and automatically closed.

8. A device for removing enamel from a nail of a toe or finger as set forth in claim 1, wherein the spongy member is a thick tubular sponge which is inverted and having numerous continuing bubbles.

9. A device for removing enamel from a nail of a human finger or toe, comprising:

a container having an inner wall surface defining a closed bottom and an open upper end;

a spongy member mountable adjacent the inner wall surface of the container, the spongy member capable of retaining a fluid; and a protective sheath mounted within the container for rotation about a first axis, the protective sheath having a sheath wall extending between a top end and a bottom end and defining an internal cavity sized for receiving the human finger or toe, the sheath wall further defining a nail exposure window, wherein at least a portion of the internal cavity adjacent the nail exposure window extends about a second axis, wherein the second axis is deflected relative to the first axis.

10. A device for removing enamel from a nail of a toe or finger as set forth in claim 9, wherein the first axis corresponds to a center axis of the container, and the second axis corresponds to a longitudinal axis of a user's finger or toe when it is located in the protective sheath, said first and second axes intersecting together inside the container.

11. A device for removing enamel from a nail of a toe or finger as set forth in claim 9, wherein the second axis is deflected from the first axis by an angle θ, where $1° \leqq \theta \leqq 30°$.

12. A device for removing enamel from a nail of a toe or finger as set forth in claim 9, wherein the protective sheath further comprises a flange portion extending from the top end and a support shaft extending from the bottom end, the flange portion being rotatably supported at the open upper end of the container and the support shift being rotatably supported at the closed bottom of the container.

13. A device for removing enamel from a nail of a toe or finger as set forth in claim 9, wherein a container closure having an inverse U-shape in cross section is fixed at the open end of the container.

14. A device for removing enamel from a nail of a toe or finger as set forth in claim 9, wherein the nail exposure window opens from adjacent the bottom end toward the top end.

15. A device for removing enamel from a nail of a toe or finger as set forth in claim 9, further comprising a removing fluid retained within the spongy member.

16. A device for removing enamel from a nail of a toe or finger as set forth in claim 9, wherein said protective sheath comprises a material selected from the group consisting of an elastic, a rubber, a metal, and a ceramic, and said protective sheath comprises an inner cavity portion with a cross section of a predetermined average human finger or toe size.

17. A device for removing enamel from a nail of a toe or finger as set forth in claim 9, wherein said protective sheath includes a pair of overlapping closure valves made of a flexible plastic film affixed adjacent the upper open end.

18. A device for removing enamel from a nail of a human finger, comprising:

a container having an inner wall surface defining a closed bottom and an opposing open end, the inner wall surface accommodating a spongy member impregnated with a removing solution;

a container closure fixed at the open end of the container; and a finger protection sheath mounted within the container for rotation about a first axis corresponding to a center axis of the container, the finger protection sheath having a sheath wall extending between a first end and a second end and defining an internal cavity sized for receiving the human finger, the sheath wall further defining a nail exposure window, wherein at least a portion of the internal cavity adjacent the nail exposure window extends about a second axis corresponding to a longitudinal axis of a user's finger when it is located in the finger protection, wherein the second axis is deflected relative to the first axis by an angle θ, where $1° \leqq \theta \leqq 30°$.

19. A device for removing enamel from a nail of a human finger as set forth in claim 18, wherein said finger protection sheath includes a pair of overlapping semicircular closure valves made of a flexible plastic film affixed adjacent the upper opening end.

20. A device for removing enamel from a nail of a human finger as set forth in claim 18, wherein said finger protection sheath comprises a material selected from the group consisting of an elastic, a rubber, a metal, and a ceramic, and wherein said protective sheath comprises an inner cavity portion with a cross section of a predetermined average human finger size.

* * * * *